United States Patent [19]

Parlour et al.

[11] 3,982,686

[45] Sept. 28, 1976

[54] SPIRAL WOUND CAN WITH PROVISION FOR PRINTING LOWER SIDE OF LABEL

[75] Inventors: A. Kenneth Parlour, Fridley; James R. Leezer; Charles H. Turpin, both of Minneapolis, all of Minn.

[73] Assignee: The Pillsbury Company, Minneapolis, Minn.

[22] Filed: Jan. 14, 1976

[21] Appl. No.: 648,989

Related U.S. Application Data

[63] Continuation of Ser. No. 502,328, Sept. 3, 1974, abandoned.

[52] U.S. Cl. ..... 229/51 BP; 229/70

[51] Int. Cl.[2] ..... B65D 5/54; B65D 17/00

[58] Field of Search ..... 229/51 BP, 70

[56] References Cited

UNITED STATES PATENTS

| | | | |
|---|---|---|---|
| 2,793,126 | 5/1957 | Fiemup et al. | 229/51 BP |
| 2,793,127 | 5/1957 | Fiemup et al. | 229/51 BP |
| 3,154,237 | 10/1964 | Culley | 229/51 BP |
| 3,215,328 | 11/1965 | White | 229/51 BP |
| 3,366,493 | 1/1968 | Stump | 229/51 BP X |
| 3,446,421 | 5/1969 | Carrigan et al. | 229/70 |
| 3,933,302 | 1/1976 | Reid et al. | 229/51 BP |
| 3,940,496 | 2/1976 | Turpin et al. | 229/51 BP |

*Primary Examiner*—Davis T. Moorhead

*Attorney, Agent, or Firm*—James V. Harmon; Michael D. Ellwein

[57] ABSTRACT

A spiral wound can is described in which the body of the can is made up of a relatively heavy fiberboard base or body stock layer lined within by an oil and moisture impermeable barrier preferably formed from a laminate of aluminum foil and paper. The base body layer includes a helically extending separation line or butt joint bonded together by the liner and label which is bonded to the body stock by at least two broken or unbroken spaced apart strips of adhesive one of which is aligned over the butt joint and one of which is spaced from the butt joint. A circumferentially extending collar cut is made through the label near the can end to facilitate its removal. Printed indicia is located on the underside of the label between the strips of adhesive.

10 Claims, 4 Drawing Figures

SPIRAL WOUND CAN WITH PROVISION FOR PRINTING LOWER SIDE OF LABEL

This is a continuation of a prior application filed by the same inventors on Sept. 3, 1974, Ser. No. 502,328 and bearing the same title, now abandoned.

THE PRIOR ART

The general purpose of the present invention is to provide a useful printing space on the underside of the fiber can label of the kind used for packing refrigerated dough products. These cans are composed of a body layer having a helically extending butt joint which defines a line of weakness that allows it to be opened along its full length when the product is to be removed. A liner bridges the inside of the butt joint and a label which is bonded over the outside of the body layer gives the butt joint the required strength prior to opening. When the label is removed, the butt joint becomes weak enough so that it can be broken by striking the can on a solid object. Cans of this kind are described in U.S. Pat. Nos. 2,793,127 and 2,793,126.

U.S. Pat. No. 3,154,237 describes a can of fiber type for dough products with a printed message strip under the label. The strip is relatively expensive and must be narrow because of the large glue area between the label and the can body layer. Other dough cans of the type commonly used in commerce prior to the introduction of the present invention provide inadequate room for standard grocery industry coupons approved in recent years by the Grocery Manufacturers Association. Two specific coupon sizes have been approved by the Association one of which is a third of an IBM card size or 3¼ inch by 2¼ inch and the other is the size of a dollar bill, approximately 6⅛ inch by 2⅝ inch. The retail grocery trade demands coupons of this size. These coupons are used in several ways. Some obtained in advertisements and on packages are turned in by the customer at the time of the purchase and then forwarded to a clearing house. Some offer a reduction in price; others have some monetary value or an equivalent value in trading stamps etc. While the present invention has general utility for providing a printing surface for a variety of uses such as recipes, cooking instructions, or nutritional information, it is particularly useful in providing a printing surface large enough to accommodate the approved 3¼ inch by 2¼ inch coupon. Unless the glue free area on the underside of the label is large enough to accommodate the coupons of that size, it is unsuited as a surface for grocery coupons.

In prior commercially manufactured fiber dough cans there has always been a narrow unglued strip about an inch wide usually located near the center of the label with glued areas on either side of it. If an attempt were made to the use of this area for printing, it would be limited to messages of relatively small size and its use for printing coupons would be impossible.

In addition to the problems already presented, the label is a functional part of the package in the sense that it must serve as a strengthening or tensile element that extends across and is glued on either side of the butt joint to the body stock material to hold the can together during shipment and storage prior to openiing the package.

OBJECTS

It is a general object of the present invention to provide a way to economically transmit grocery store coupons to the purchasers of refrigerated biscuits even though there is no space available on either the front or back of the label now in commercial use. More specific objects are a) to provide enough space on the lower side of the label for at least a 3¼ inch by 2¼ inch coupon or other printed information including recipes, meal instructions, nutritional information etc. b) to provide a seal between the label and the underlying can body layer in the region of the butt joint that will give the butt joint sufficient strength during shipment and storage but at the same time leaving adequate space for printing, c) to provide a means for using standard manufacturing equipment in producing the containers, d) provide a package which is inexpensive and rugged in construction and e) a package which can be manufactured from the standard commercially available materials.

THE FIGURES

THE SUMMARY

Figure 1:
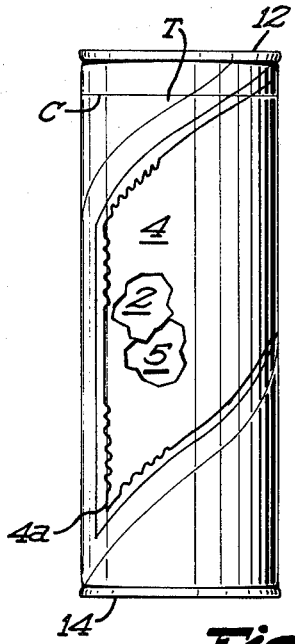
FIG. 1 is a side elevational view of a can embodying the invention.

A spiral wound can is described in which the body of the can is made up of a relatively heavy fiberboard base or body stock layer preferably lined within by an oil and moisture impermeable barrier typically formed from a laminate of aluminum foil and paper. The base body layer includes a helically extending separation line or butt joint bonded together by the liner on the inside. A label covers the body stock and is bonded to the body stock by at least two broken or unbroken spaced apart strips of adhesive one of which is aligned with the butt joint and one of which is spaced from the butt joint and the strip of adhesive over the butt joint is usually less than about one fourth the width of the label. A circumferentially extending collar cut through the label or the like is provided to facilitate its removal. Printed indicia is located on the underside of the label between the strips of adhesive.

The position of the label and body layers are related during manufacture so that the butt joint is located relatively close to one edge of the label specifically in a typical application less than about a half an inch from the edge of the label. The adhesive strip on the opposite edge of the label from the first strip or butt strip is narrower than the butt strip and usually greater than a quarter of an inch but less than a half inch in width and the inner edge thereof extends no more than 25% of the way from the adjacent edge to the opposite edge of the label. The butt joint line is aligned from about 10% to 20% of the way from one label edge to the opposite edge.

DESCRIPTION OF THE PREFERRED EMBODIMENT

An understanding of the construction of the container can be gained through a brief description of the operations used to form it.

A winding mandrel of standard construction is provided with the usual winder W having a belt or the like entrained over the mandrel for drawing the various webs including the body stock 2 onto the mandrel. The body stock sheet 2 and liner 5 are wound continuously onto the mandrel and travel from left to right in the figures thereby forming a helically extending butt joint 7 where the adjacent convolutions of the body stock 2 contact one another.

A liner 5 formed from a relatively tough barrier material such as the composite of kraft paper and aluminum foil is applied to the mandrel and wound inside the body stock 2. Adhesive is applied to the body stock to bond the liner in place and to bond the liner to the body stock 2 in the area of the joint 7 to form a reinforcement for the joint.

A label 4 which functions as a protective coating and printing surface is applied and bonded by two strips of adhesive which can be either continuous or discontinuous i.e. a series of spots. After the tube has been completely formed in this manner, it is ultimately cut into can lengths as shown by dotted lines 3. The tube is then cut circumferentially only partially through its thickness specifically through the label 4. The cut C, which is often referred to as a "collar cut" does not extend through the body stock layer 2 and is located relatively close to one end of the container, normally about one half of an inch from one end to define a lifting tab T which functions as a means for allowing the label to be removed manually. By "relatively close to the end" is meant that the collar cut should be placed no more than about an inch or two from the end of the container end preferably less than an inch from the end. In any event, the collar cut should be close enough to the can end so the can will open after the label is removed. The container is now ready for filling and capping.

The finished package embodying the present invention is thus comprised of an elongated cylindrical container body. The butt joint 7 extends generally longitudinally and helically on the can. The inner proective layer formed from flexible sheet material is positioned adjacent and bonded to the inner wall of the body stock to help prevent the loss of moisture and oil from the can and is bonded on either side of the butt joint (which itself has no adhesive) to hold the joint together. The label 4 is positioned adjacent to the outer surface of the body stock 2 as mentioned above to provide a printing surface and to prevent ambient moisture from harming the container body and its contents.

The bottom cap 14 is normally applied before filling. After the container is filled with dough products, the cover 12 is secured to the top. The bottom covers are secured in place conventionally by crimping or seaming with commercially available equipment.

The body stock sheet 2 is relatively thick compared with the liner and the label. It often consists of kraft paper of 0.020 inches thick or of cylinderboard, for example 0.026 inches in thickness and functions as a stiffening member to provide shape, thickness, and overall strength. The liner 5 consists, for example, of 25 pounds per 3000 square feet kraft paper laminated to 0.00035 inch thick aluminum foil. The inner layer of liner 5 is bonded to the core 2 by means of adhesive and by bridging the butt joint 7, holds the butt joint intact even after the removal of the label.

The label 4, can be formed from any relatively lightweight sheet material which can function as a printing surface. It can, for example, be formed from any suitable flexible sheet material such as a laminate of paper and foil as mentioned above but can be of other construction such as 45 – 55 pounds per ream clay coated bleached kraft either supercalendered or machine glazed. The clay coating is of a type treated with chromium complex to reduce grease wicking. It can also be plastic e.g. polystyrene film. If of paper, moisture and oil surface resistance is provided by suitable coatings e.g. vinyl coatings applied on the printed press as a part of the printing operation. The label is usually printed on its outer surface.

The label 4 thus serves as an oil and moisture barrier and as a surface for printed indicia **4*a* and also provides support to butt joint 7** until removed when tab T is lifted.

The label 4 is bonded to the body 2 by two adhesive strips; strips 15 (which will be referred to as the butt joint strip since it is bonded across butt joint 7) and 16 between which is an unbonded or free strip 17. It will be seen that the strip 16 is relatively narrow compared with 15 and that there are narrow unglued edges 18 and 20 laterally of the strips 16 and 15 respectively. The unglued strip 17 is much wider than strips 15 and 16 usually at least four times as wide as strip 15. The extreme edges 18 and 20 of the label 4 which are free from adhesive can be made by scraping the edges free from adhesive just before the label is wound into tubular form with the underlying unglued edge 20 about an eighth of an inch wide or so and the overlying adhesive free edge 24 about 3/32 of an inch wide.

In a typical applicaton assuming that the label if formed from the strip material approximately 4⅛ inches wide, the adhesive strip 16 should be greater than ¼ inch wide and strip 17 should be greater than about 2¼ inches wide to receive the imprinted indicia for the coupon. The butt joint adhesive strip 15 should be less than 25% of the label strip width. It is important that the butt joint line 7 be aligned under the label at a position between about 10% and 20% of the way from the adjacent edge to the opposite edge.

In a preferred form of the invention the part of the strip 15 (**15*a*) which is closest to the edge of the label is greater than about 5/16 of an inch and section 15*b* is greater than about 3/16 of an inch. The total width of the label is of course established by the winding angle and the degree to which the edges of the label overlap themselves. An overlap of about 3/32 of an inch is typical. It is of course known that for any given can diameter and label width there is only helix angle possible with respect to the axis of the can. In one can made in accordance with the invention, strip 15*a* was 7/16 inch wide and 15*b* was 5/16 ± ⅛ inch wide, the total width of strip 15 therefore three-fourths of an inch. The reason that the butt joint line 7 is offset with respect to the edges of strip 15 is that the outer portion of 15*a* is believed to be more subject to attack by moisture etc. and becomes weakened more easily than 15*b*. Thus, offset the position of the butt joint line 7 on the glue strip area 15 places the butt joint line 7 far enough from the adjacent label edge to prevent moisture from weakening the bond area to the point where an unacceptable number of the cans burst open prior to the opening by the user. It was found that in available can forming machinery the butt joint line 7 wanders toward one side and then the other of the adhesive strip 15. Partly for this reason a substantially stronger and more reliable seal can be made to prevent premature popping open of the can if the portion 15***a* of the strip is wider than portion 15*b*.

Figure 2:
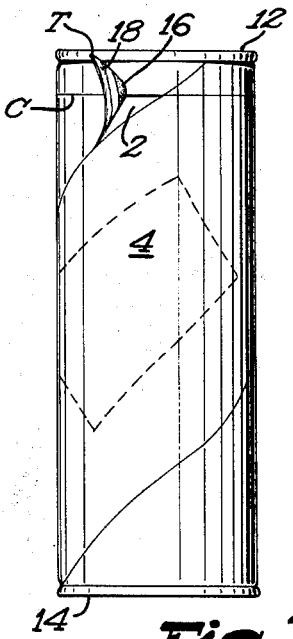
FIG. 2 is a view similar to FIG. 1 showing the label as it appears with the first part of it removed during the opening operation.
Figure 3:
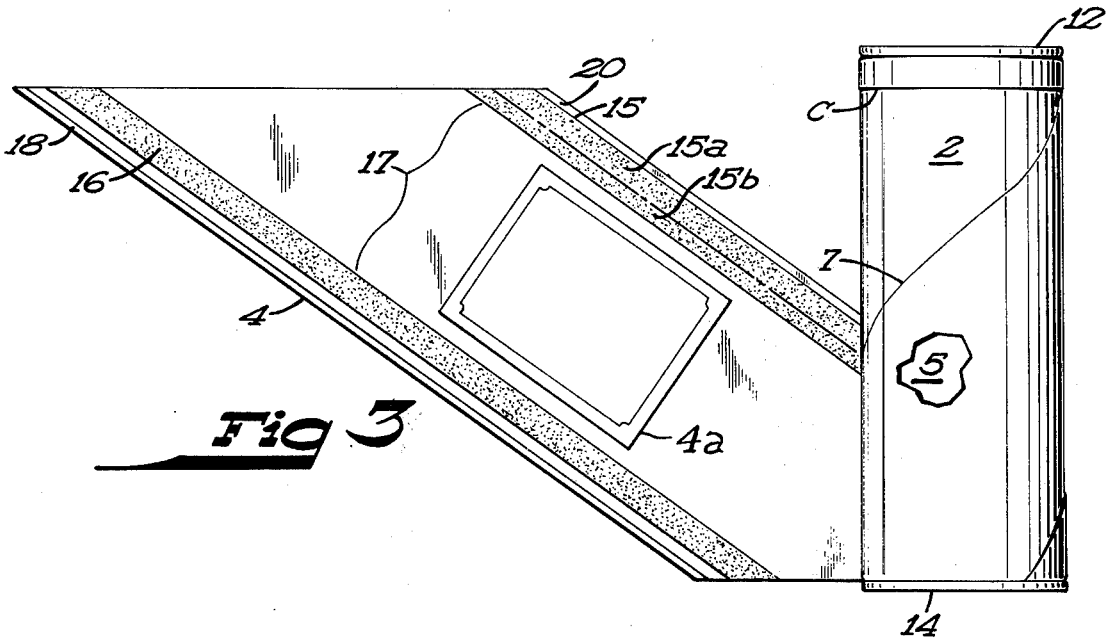
FIG. 3 is a similar view of the can with almost all of the label removed showing the glue pattern on the undersurface of the label and the can body layer.
Figure 4:
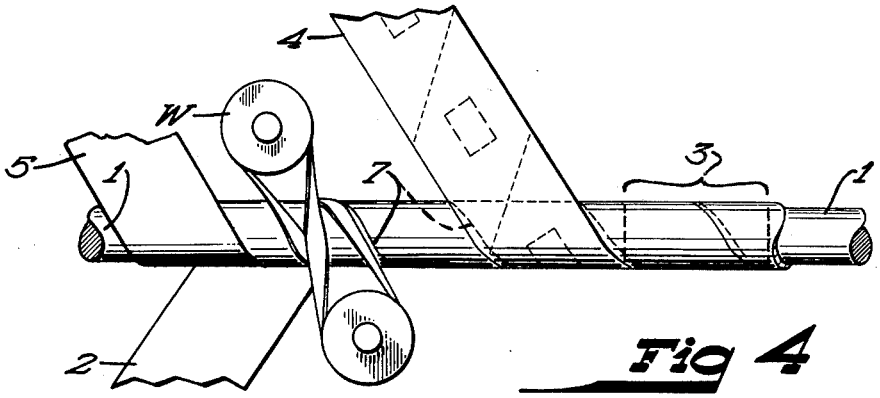
FIG. 4 is a plan view showing the relative positions of the liner, body layer and label during the can forming operation.

The filled container appears as shown in FIG. 3. To open the container, one grasps the adhesive free edge 18 of the label adjacent the collar cut C which functions as a tab T and lifts the label as shown in FIG. 2.

After the label is removed, the butt joint is weakened which allows the can to open easily when struck against a solid object. This causes the liner bridging the butt joint inside surface to rupture along its almost full length simultaneously thereby causing the can to open from one end to the other. Then, by twisting the ends of the container lightly, the opening can be enlarged thereby allowing the biscuits or other food product to be quickly removed. The label removal usually weakens the butt joint by a factor of from about 40% – 70% or more assuming the label is of about the same thickness and strength as the liner.

It can thus be seen that the package in accordance with the invention provides almost double the amount of available printing surface and a free space large enough for standard coupons.

What is claimed is:

1. An easily opened fiber can for food products, said can comprising, a. a helically wound body stock layer formed from an elongated strip of flexible sheet material having its side edges abutted against one another to form a helically extending butt joint defining a separation line adapted to part when the can is opened, b. a moisture resistant helically wound inner liner aginst the inside surface of the body stock layer, the liner being bonded to the inner surface of the body stock layer, c. a label strip wound helically over the body stock layer and being bonded thereto by two relatively narrow adhesive strips, one strip extending along substantially each side edge of the label strip, d. a relatively wide adhesive free area extending helically on the inner surface of the label strip between the relatively narrower adhesive strips and the adhesive strips and the adhesive free area being of a width of over half of the label strip width, e. printed indicia applied to the adhesive free area on the inner surface of the label, f. one of said two adhesive strips on the edge of the label being bonded over the separation line and having a width less than about one forth the width of the label but sufficiently wide to hold the separation line together prior to removal of the label, g. the separation line being located between about 10 percent and 20 percent of the way from one edge of the label strip to the opposite edge of the label strip, h. means to facilitate lifting a portion of the label so that it can be peeled back and removed, i. the removal of the label causing the separation line to be weakened sufficiently to allow the can to be opened along the separation line, and j. at least one end closure member affixed to one end of the can.

2. The can according to claim 1 wherein the glue strip overlying the butt joint is on the order of three-fourths of an inch in total width and the butt joint is located about 5/16 ± ⅛ inch from said central edge thereof.

3. The can of claim 1 wherein the printed indicia is a coupon.

4. The can of claim 1 wherein the adhesive strips are unbroken strips of glue.

5. The can of claim 1 wherein the inner liner is a moisture and oil resistant laminate of aluminum foil and paper.

6. The can of claim 1 wherein the label is a laminate of metal foil and paper.

7. The can of claim 1 wherein the label comprises a member selected from the group consisting of clay coated paper and plastic film.

8. The can of claim 1 wherein the label is clay coated kraft paper having a vinyl coating to provide moisture and oil resistance.

9. The can of claim 1 wherein the unbonded center section is at least four times the width of the glue strip that is bonded over the butt joint.

10. an easily opened fiber can for food products, said can comprising, a. a helically wound body stock layer formed from an elongated strip of flexible sheet material having its side edges abutted against one another to form a helically extending butt joint defining a separation line adapted to part when the can is opened, b. a moisture resistant helically wound inner liner against the inside surface of the body stock layer, the liner being bonded to the inner surface of the body stock layer, c. a label strip wound helically over the body stock layer and being bonded thereto by two relatively narrow adhesive strips, one strip extending along substantially each side edge of the label strip, d. a relatively wide adhesive free area extending helically on the inner surface of the label strip between the relatively narrower adhesive strips and the adhesive free area being of a width of over half of the label strip width, e. printed indicia applied to the adhesive free area on the inner surface of the label, f. one of said two adhesive strips on the edge of the label being bonded over the separation line and having a width less than about one fourth the width of the label but sufficiently wide to hold the separation line together prior to removal of the label.

g. the separation line being located between about 10 percent and 20 percent of the way from one edge of the label strip to the opposite edge of the label strip, h. the separation line being closer to the central edge of the overlying adhesive strip than to the peripheral edge of the overlying adhesive strip, i. means to facilitate lifting a portion of the label so that it can be peeled back and removed, j. the removal of the label causing the separation line to be weakened sufficiently to allow the can to be opened along the separation line, and k. at least one end closure member affixed to one end of the can.

* * * * *